United States Patent [19]

Vandelinde

[11] Patent Number: 4,749,060

[45] Date of Patent: Jun. 7, 1988

[54] MODULAR STAGE PLATFORM

[75] Inventor: Henry Vandelinde, Claremont, Canada

[73] Assignee: Swing Stage Limited, Scarborough, Canada

[21] Appl. No.: 92,722

[22] Filed: Sep. 3, 1987

[51] Int. Cl.[4] ..... E04G 5/08

[52] U.S. Cl. ..... 182/222; 182/113

[58] Field of Search ..... 182/222, 223, 113, 142, 182/150

[56] References Cited

U.S. PATENT DOCUMENTS

| | | | |
|---|---|---|---|
| 2,070,334 | 2/1937 | Garber | 182/222 |
| 2,726,123 | 12/1955 | Mathews | 182/222 |
| 3,374,861 | 3/1968 | Shaver | 182/222 |
| 3,379,281 | 4/1968 | Calletti | 182/113 |
| 3,994,036 | 11/1976 | Fisher | 182/222 |
| 4,164,268 | 8/1979 | Jones | 182/150 |
| 4,499,967 | 2/1985 | Anderson | 182/142 |
| 4,583,618 | 4/1986 | Zimmerman | 182/223 |
| 4,620,612 | 11/1986 | Enoki | 182/113 |
| 4,624,342 | 11/1986 | Anderson | 182/223 |

*Primary Examiner*—Reinaldo P. Machado
*Attorney, Agent, or Firm*—Arne I. Fors; Robert F. Delbridge

[57] ABSTRACT

Modular stage platform comprises a pair of parallel, spaced-apart base members each comprising an elongated extrusion having an upstanding wall defining a continuous toe plate and an inwardly facing channel at the bottom thereof, the channels of the pair of spaced apart base members being opposed to each other, a plurality of equispaced transverse tubular members having opposite ends inserted into said opposed channels and secured thereto along said base members, a pair of parallel, spaced-apart midrails, each comprising an elongated U-shaped extrusion having a pair of walls depending downwardly from a web, said walls having opposed ridges formed on their inner sides spaced from the distal ends thereof and spaced from the web to form a continuous, downwardly-facing recess along the length of each rail and an inner box-like cavity, a plurality of equispaced vertical tubular members having their upper ends inserted into said recess and their lower ends abutting the base member channel rigidly secured thereto in alignment with the said transverse members to form a plurality of equispaced, U-shaped tubular reinforcing units, a plurality of diagonal tubular members extending from the rail to the base member and secured thereto, elongated flooring members seated on said transverse members and secured thereto, and connectors formed at the opposite ends of each of the base members and midrails for connecting a plurality of modular stage platforms together end-to-end.

3 Claims, 6 Drawing Sheets

MODULAR STAGE PLATFORM

BACKGROUND OF INVENTION

This invention relates to a stage platform and, more particularly, relates to a lightweight modular stage platform.

Stage platforms for suspension from the sides of high structures and buildings for construction, washing windows, servicing of the building and the like functions are well known. Conventional staging is sturdily built and, as a result, normally is somewhat heavy, cumberson to handle and not easily adapted to be assembled in various lengths and shapes.

It is a principal object of the present invention to provide a modular stage platform which is light in weight, easily handled and suspended from the sides of buildings and other structures, and is strong and rigid structurally.

Another important object of the present invention is the provision of a modular stage platform which can be readily extended into various lengths and shapes.

STATEMENT OF INVENTION

These and other objects of the invention can be accomplished by the modular stage platform of the invention which, in its basic aspect, comprises a pair of parallel, spaced-apart base members each comprising an elongated extrusion having an upstanding wall defining a continuous toe plate and an inwardly facing channel at the bottom thereof, the channels of the pair of spaced apart base members being opposed to each other, a plurality of equispaced transverse tubular members having opposite ends inserted into said opposed channels and secured thereto along said base members, a pair of parallel, spaced-apart midrails, each comprising an elongated U-shaped extrusion having a pair of walls depending downwardly from a web, said walls having opposed ridges formed on their inner sides spaced from the distal ends thereof and spaced from the web to form a continuous, downwardly-facing recess along the length of each rail and an innder box-like cavity, a plurality of equispaced vertical tubular members having their upper ends inserted into said recess and their lower ends abutting the base member channel rigidly secured thereto in alignment with the said transverse members to form a plurality of equispaced, U-shaped tubular reinforcing unitsm a plurality of diagonal tubular members extending from the rail to the base member and secured thereto, elongated flooring members seated on said transverse members and secured thereto, and connectors formed at the opposite ends of each of the base members and midrails for connecting a plurality of modular stage platforms together end-to-end.

The connectors comprise an upper male connector and a lower female connector at one side of the platform at one end thereof and an upper female connector and a lower male connector at the opposite end of a platform at the same end thereof, with different mating connectors at the opposite end thereof, and removable fastening means for securing mating ends of a pair of platforms together at the connectors.

The fastening means preferably comprises a cylindrical rod split at one end for receiving a gravity pin pivotally mounted therein and having an L-shaped rod secured perpendicular thereto at the opposite end of the cylindrical rod, whereby the fastening means are insertable into aligned openings in the male and female connectors for locking therein.

BRIEF DESCRIPTION OF THE DRAWINGS

The invention will now be described in detail with reference to the accompanying drawings, in which.

DESCRIPTION OF THE PREFERRED EMBODIMENT

Figure 1:
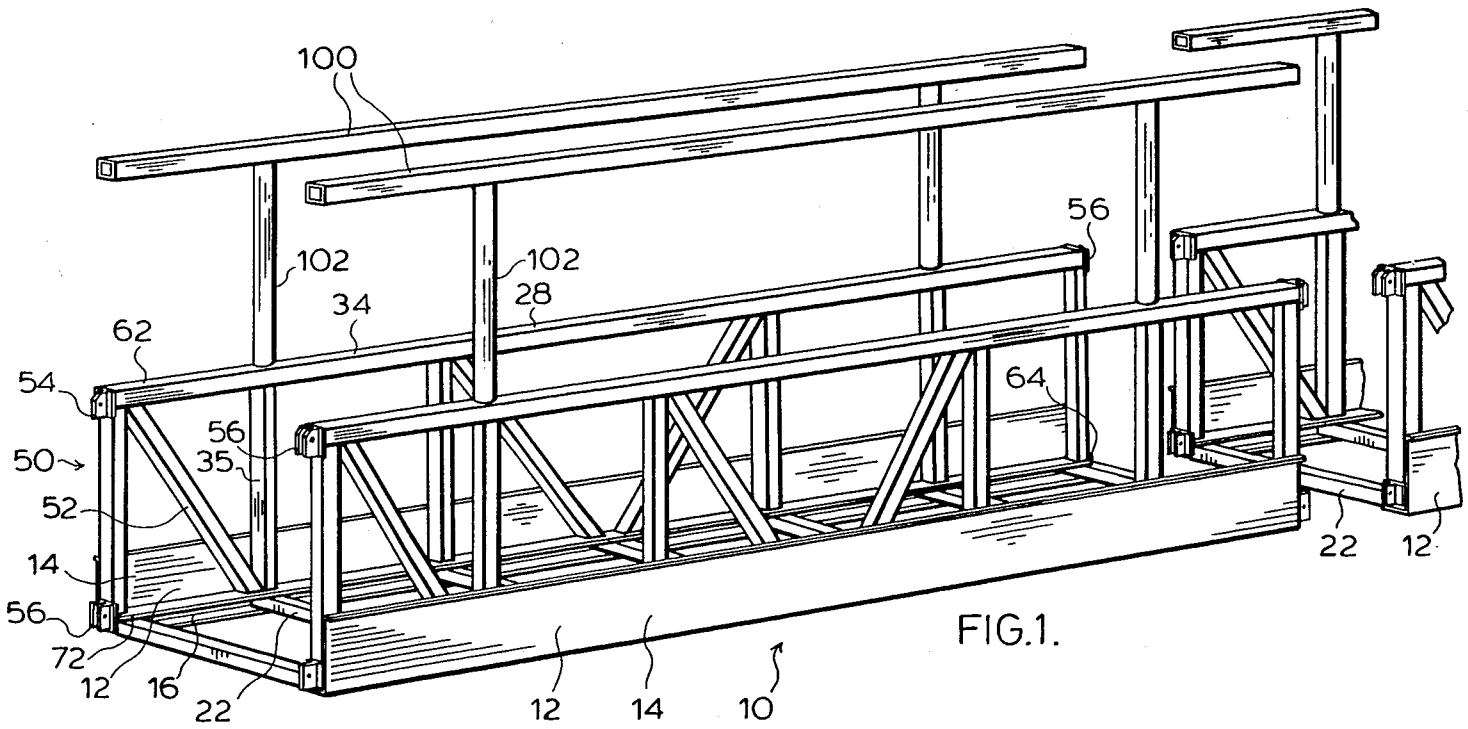
FIG. 1 is a perspective view of modular stage platforms of the present invention preparatory to assembly together.

With reference to FIGS. 1–4 of the drawings, the modular stage platform 10 of the invention comprises a pair of parallel, spaced-apart base members 12 formed preferably by means of extrusion from a light-weight metal such as high tensile aluminum alloy. Each base member 12 has an upstanding wall 14 defining a continuous toe plate and an inwardly facing channel 16 having upper and lower walls 18, 20. The pair of parallel base members 12 define opposed channels 16 for receiving a plurality of equispaced transverse tubular members 22 having opposite ends 24, 26 inserted into opposed channels 16 and welded thereto by means of fillet welds 27 parallel to the longitudinal axis of the stage platform.

It is to be noted that all structural components are formed of high-tensile aluminum alloy and essentially all welds are 1/8 inch fillet welds continuously in alignment with the longitudinal axis of the structure with no welds extending across the width of structural members.

Figure 4:
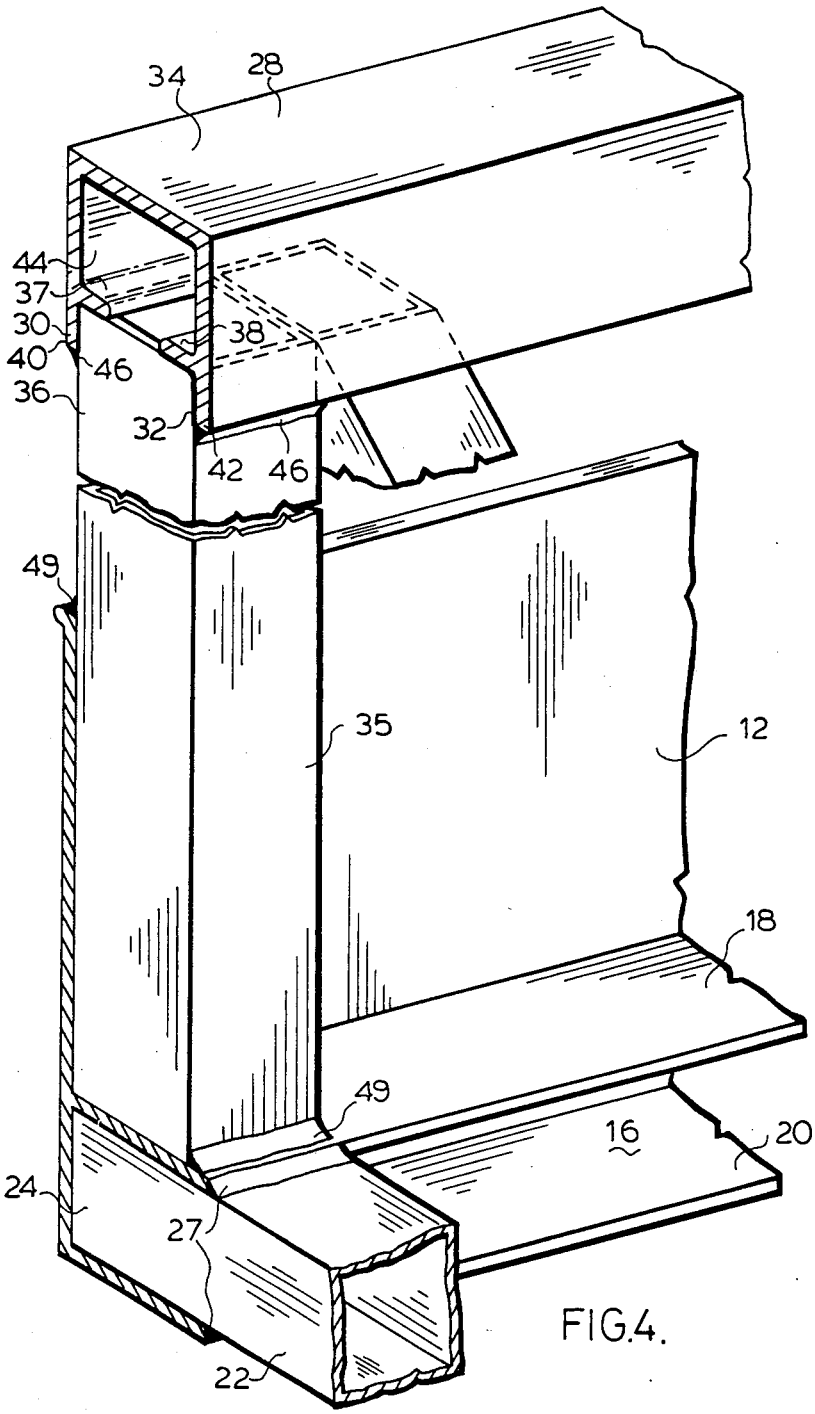
FIG. 4 is a perspective view, partly cut away, of a corner of the platform.

A pair of parallel, spaced-apart U-shaped midrails 28 having a pair of downwardly extending walls 30, 32 depending from web 34, shown more clearly in FIG. 4, are disposed above base members 12 parallel thereto and interconnected by means of a plurality of equispaced vertical tubular members 35. The upper ends of tubular members 35 are inserted into a longitudinal recess 36 defined by the distal ends 40, 42 of walls 30, 32 and by inwardly extending, opposed ridges 37, 38 formed a spaced distance from the said distal ends 40, 42, said opposed ridges 37, 38 being spaced from the web 34 to form a box-like cavity 44 therein.

The lower ends of tubular members 35 abut the inside of upper channel wall 18, the tubular members being rigidly secured to rails 28 and to walls 18 by longitudinal fillet welds 46, 49.

Each pair of vertical tubular members 35 is in longitudinal alignment with a transverse member 22 to form a generally U-shaped tubular reinforcing component 50 for reasons which will become apparent as the description proceeds. Wooden planking, or preferably extruded metal floor members 51, are seated longitudinally in abutting relation on transverse members 22 to form a continuous floor extending the length of the staging.

Diagonal tubular members 52 inserted into recesses 36 extend downwardly from each of midrails 28 to the base member 12 adjacent the next transverse member 22, being secured to the walls 30, 32 of rails 28 and to base members 12, again by longitudinal fillet welds, not shown.

The connectors consist of male and female connectors 54, 56 respectively, shown most clearly in FIGS. 5–8, each male connector 54 having a central vertical plate 58 extending from transverse base 60 secured to the end 62 of rail 28 and to the end 64 of the base member at the opposite end of the platform on the same side thereof, and each female connector 56 having a pair of spaced-apart vertical plates 66, 68 extending from transverse base 70 secured to the end 72 of base member 12 below a male connector 54. In like manner, a female connector 56 is secured to the opposite end of the rail on the same side of the platform to provide mating male and female connectors upon abutment of the ends of a pair of modular staged platforms.

Figure 6:
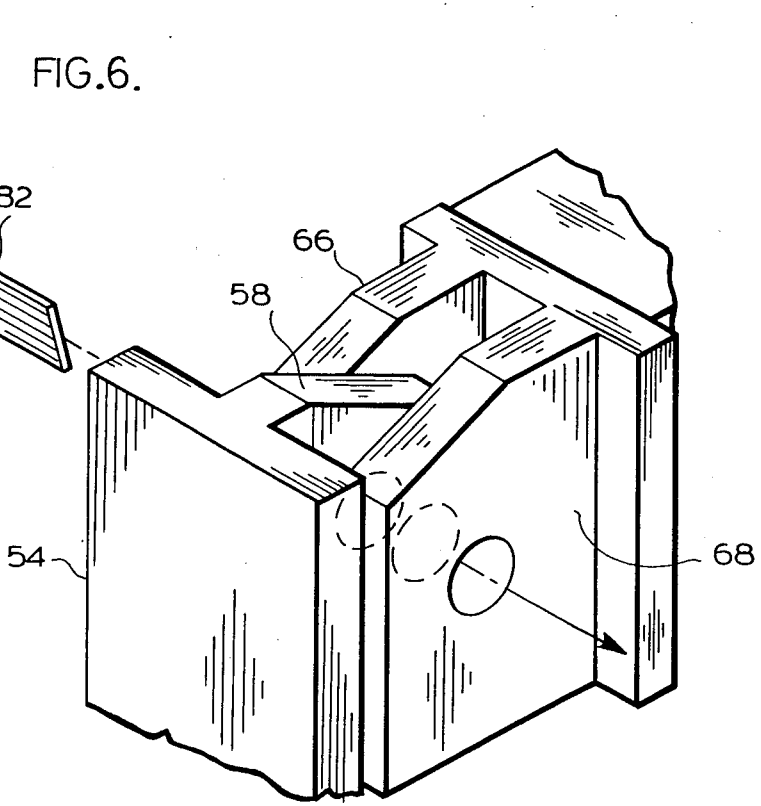
FIG. 6 is a perspective view of the connectors shown in FIG. 5 assembled to receive a connecting pin.
Figure 7:
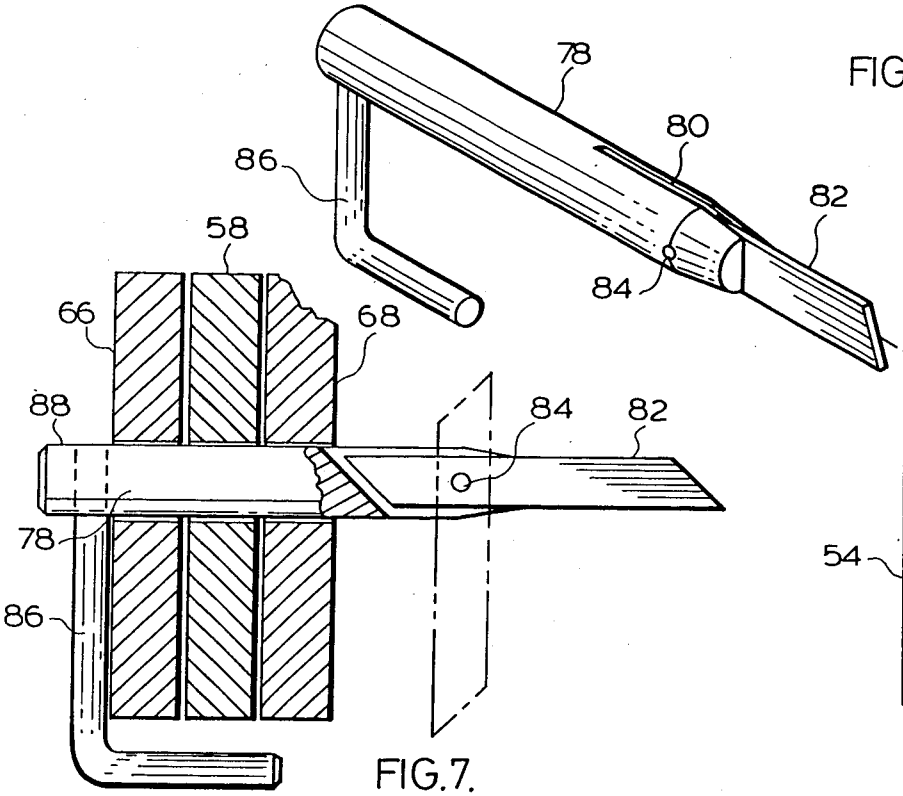
FIG. 7 is a vertical section through the connectors shown assembled in FIG. 6 with a connecting pin inserted, and in its operative locking configuration.
Figure 8:
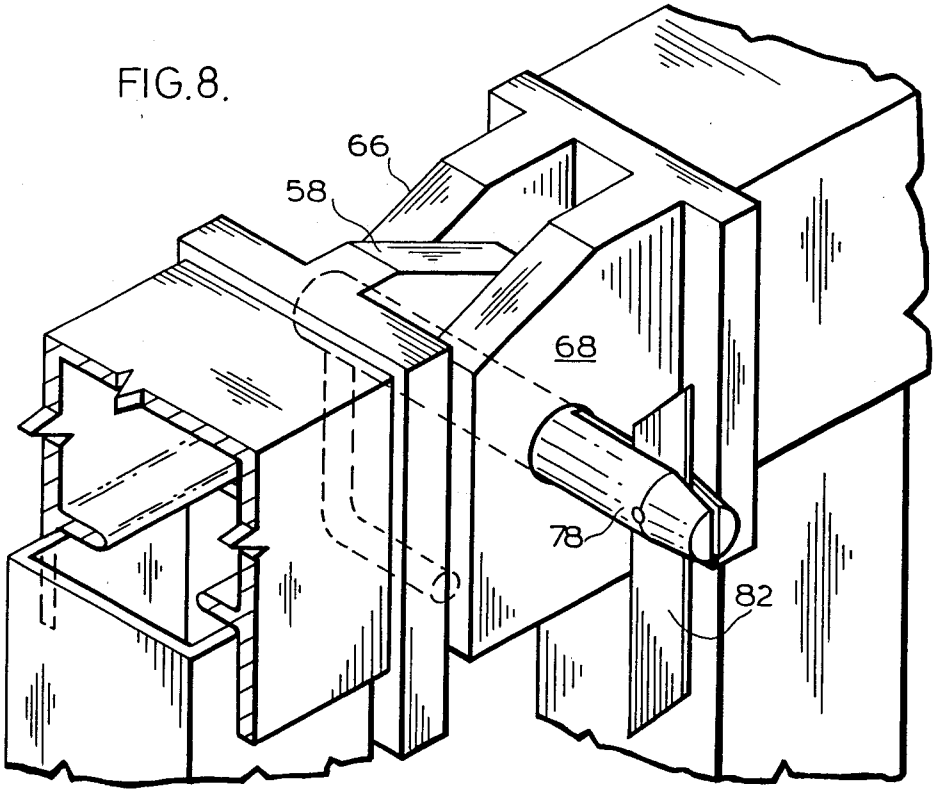
FIG. 8 is a perspective view of the connectors locking opposite ends of end-to-end staging together.

Each fastener 76 shown most clearly in FIGS. 6–8 comprises cylindrical rod 78 split at one end 80 to receive gravity pin 82 pivotally mounted at 84. L-shaped rod 86 welded to or swaged into opposite end 88 of rod 78 is provided for joining together mating connectors 54, 56 by insertion of rod 78 through aligned holes 90, 92 with L-shaped rod 86 turned downwardly such that gravity pin 82 will automatically pivot by gravity into the locking position shown in FIG. 7.

Figure 2:
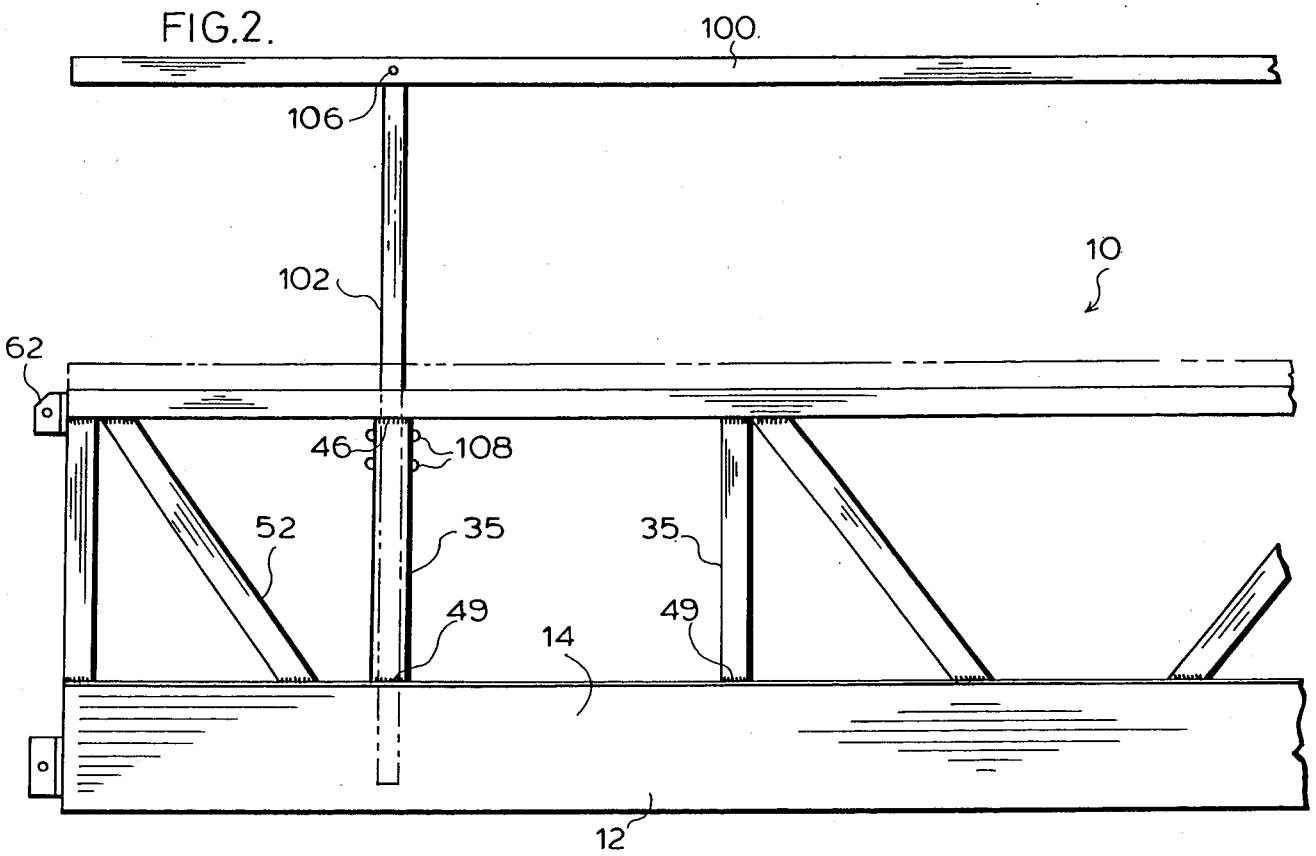
FIG. 2 is a front elevation, partly cut away, of the platform shown in FIG. 1.
Figure 3:
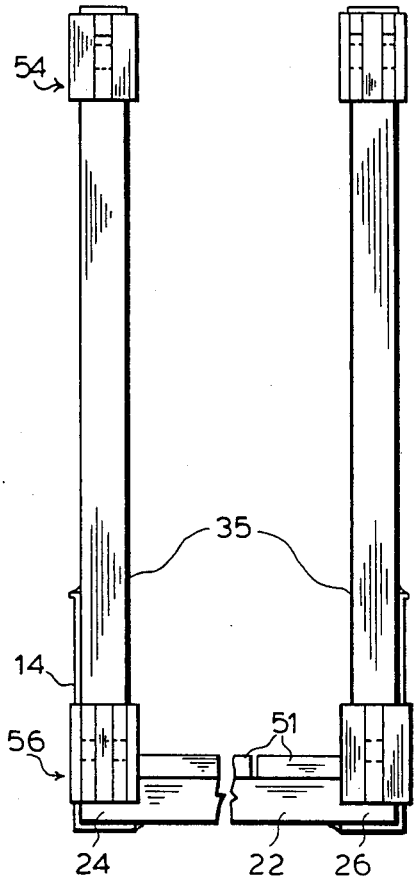
FIG. 3 is an end elevation, partly cut away, of the platform shown in FIG. 1.
Figure 5:
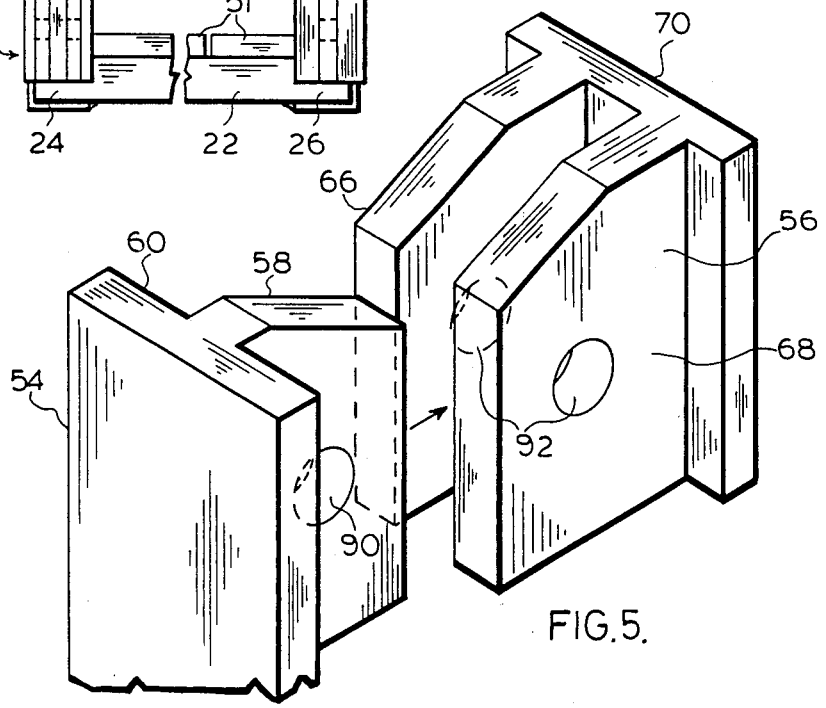
FIG. 5 is a perspective view of male and female connectors preparatory to assembly.

With reference now to FIGS. 1 and 2, an upper rail 100 is spaced parallel to each of midrails 28 and secured thereto by means of vertical tubular member 102 of reduced cross-section, which is preferably round, for a telescopic or sliding fit into upright tubular member 35 through openings formed in the web 34 in rails 28. Vertical members 102 preferably are detachably secured to upper rail 100 and to upright tubular members 35 by bolts 106, 108.

The present invention provides a number of important advantages. The structure can be readily manufactured and welded by longitudinal fillet welds during passage through welding stations continuously in line with the longitudinal axis of the platform. The insertion of the transverse and vertically upright tubular members joining the rails and base members together into channels and recesses and welding therein by longitudinal welds into an integral structure provides surprising transverse rigidity to the structure, thus permitting minimum lateral and vertical deflection under load conditions. Load testing of a modular stage platform having a 28 inch width and 24 inch height of midrail 28 above base members 12, with total loads up to 3,000 pounds for vertical testing and up to 750 pounds for side-rail deflection and reverse loading, indicated no distress or deformation noted in accordance with Underwriters Laboratories Inc. test procedure UL1322, sections 7, 8, 9, 10 and 11.

It will be understood of course that modifications can be made in the embodiment of the invention illustrated and described herein without departing from the scope and purview of the invention as defined by the appended claims.

I claim:

1. A modular stage platform comprising a pair of parallel, spaced-apart base members each comprising an elongated extrusion having an upstanding wall defining a continuous toe plate and an inwardly facing channel at the bottom thereof, the channels of the pair of spaced apart base members being opposed to each other, a plurality of equispaced transverse tubular members having opposite ends inserted into said opposed channels and secured thereto along said base members, a pair of parallel, spaced-apart midrils, each comprising an elongated U-shaped extrusion having a pair of walls depending downwardly from a web, said walls having opposed ridges formed on their inner sides spaced from the distal ends thereof and spaced from the web to form a continuous, downwardly-facing recess along the length of each rail and an inner box-like cavity, a plurality of equispaced vertical tubular members having their upper ends inserted into said recess and their lower ends abutting the base member channel rigidly secured thereto in alignment with the said transverse members to form a plurality of equispaced, U-shaped tubular reinforcing units, a plurality of diagonal tubular members extending from the rail to the base member and secured thereto; a plurality of elongated flooring members seated on said transverse members and secured thereto; and connectors formed at the opposite ends of the said platform for connecting a plurality of modular stage platforms together in end-to-end relation.

2. A modular stage platform as claimed in claim 1 in which said connectors comprise an upper male connector and a lower female connector at one side of the platform at one end thereof and an upper female connector and a lower male connector at the opposite side of a platform at the same end thereof, with different mating connectors at the opposite end thereof, and removable fastening means for securing together male and female connectors at mating ends of a pair of platforms.

3. A modular stage platform as claimed in claim 2 in which the fastening means comprises a cylindrical rod split at one end for receiving a gravity pin pivotally mounted therein and an L-shaped rod secured perpendicular thereto at the opposite end of the cylindrical rod, whereby the fastening means are insertable into aligned openings in the male and female connectors for locking therein.

* * * * *